US009010889B2

(12) United States Patent
Jung et al.

(10) Patent No.: US 9,010,889 B2
(45) Date of Patent: Apr. 21, 2015

(54) REFRIGERATOR WITH SEALING APPARATUS FOR DRAWER

(71) Applicant: LG Electronics Inc., Seoul (KR)

(72) Inventors: Moongyo Jung, Seoul (KR); Dullae Min, Seoul (KR); Sanggyun Lee, Seoul (KR); Ahreum Park, Seoul (KR)

(73) Assignee: LG Electronics Inc., Seoul (KR)

( * ) Notice: Subject to any disclaimer, the term of this patent is extended or adjusted under 35 U.S.C. 154(b) by 10 days.

(21) Appl. No.: 13/947,678

(22) Filed: Jul. 22, 2013

(65) Prior Publication Data

US 2014/0021846 A1 Jan. 23, 2014

(30) Foreign Application Priority Data

Jul. 23, 2012 (KR) ..... 10-2012-0080180

(51) Int. Cl.
*A47B 96/04* (2006.01)
*F25D 25/02* (2006.01)
*F25D 17/04* (2006.01)

(52) U.S. Cl.
CPC ..... *F25D 25/025* (2013.01); *F25D 17/042* (2013.01); *F25D 2317/043* (2013.01)

(58) Field of Classification Search
CPC ... F25D 25/025; E05B 65/46; A47B 2210/17; A47B 2210/175; A47B 2210/19
USPC ..... 312/402, 404, 332.1, 333, 215, 222, 312/296; 62/449
See application file for complete search history.

(56) References Cited

U.S. PATENT DOCUMENTS

| | | | | |
|---|---|---|---|---|
| 2,463,250 | A * | 3/1949 | Curtiss, Jr. | 49/317 |
| 3,292,985 | A * | 12/1966 | Buhrmaster | 312/332.1 |
| 6,351,379 | B1 * | 2/2002 | Cheng | 361/679.33 |
| 6,431,615 | B1 * | 8/2002 | Bastian | 292/80 |
| 6,527,353 | B1 * | 3/2003 | Bradfish et al. | 312/332.1 |
| 6,851,286 | B2 * | 2/2005 | Dube et al. | 70/81 |
| 6,953,232 | B2 * | 10/2005 | Busby et al. | 312/332.1 |
| 8,172,346 | B2 * | 5/2012 | Tafoya et al. | 312/404 |
| 8,277,005 | B2 * | 10/2012 | Jung et al. | 312/405 |
| 8,408,663 | B2 * | 4/2013 | Chellappan et al. | 312/402 |
| 8,608,261 | B2 * | 12/2013 | Retchloff et al. | 312/332.1 |
| 2002/0135187 | A1 * | 9/2002 | Bastian | 292/121 |
| 2003/0117048 | A1 * | 6/2003 | Mueller | 312/330.1 |
| 2004/0060319 | A1 * | 4/2004 | Wood | 62/441 |
| 2006/0042305 | A1 * | 3/2006 | Oh et al. | 62/407 |
| 2008/0289355 | A1 * | 11/2008 | Kang et al. | 62/344 |
| 2008/0302441 | A1 * | 12/2008 | Kelly et al. | 141/65 |
| 2009/0195134 | A1 * | 8/2009 | Liu et al. | 312/348.6 |
| 2010/0019636 | A1 * | 1/2010 | Chen et al. | 312/332.1 |

(Continued)

*Primary Examiner* — Hanh V Tran
(74) *Attorney, Agent, or Firm* — McKenna Long & Aldridge LLP

(57) ABSTRACT

A refrigerator includes a refrigerator main body, a case forming a storage space with a front surface open, a drawer received in the case to be drawn out, a sealing apparatus having hooks disposed on the drawer and rotatable between a sealing position of maintaining a sealed state with being engaged with the case and a release position of releasing the engaged state with the case, and hook springs applying an elastic force to the hooks to be rotated to the sealing position, a manipulation handle rotatably disposed on the drawer and rotating the hooks to the release position when being pulled, and an operation bar to transfer a driving force of the manipulation handle to the hooks. Accordingly, reception and sealing of the drawer may be simultaneously realized and unsealing and drawing-out of the drawer may also be simultaneously realized.

19 Claims, 9 Drawing Sheets

(56) References Cited

U.S. PATENT DOCUMENTS

2010/0090575 A1* 4/2010 Uthuppan ..... 312/404
2011/0006655 A1* 1/2011 Seo et al. ..... 312/402
2011/0050066 A1* 3/2011 Lee et al. ..... 312/404
2011/0121701 A1* 5/2011 Chang ..... 312/332.1
2011/0289957 A1* 12/2011 Kim et al. ..... 62/404
2012/0126680 A1* 5/2012 Lee et al. ..... 312/408

* cited by examiner

REFRIGERATOR WITH SEALING APPARATUS FOR DRAWER

CROSS-REFERENCE TO RELATED APPLICATION

Pursuant to 35 U.S.C. §119(a), this application claims the benefit of earlier filing date and right of priority to Korean Application No. 10-2012-0080180, filed on Jul. 23, 2012, the contents of which is incorporated by reference herein in its entirety.

BACKGROUND OF THE DISCLOSURE

1. Field of the Disclosure

This specification relates to a refrigerator having a sealing apparatus for a drawer, and particularly, to a refrigerator having a sealing apparatus for a drawer, capable of drawing out and pushing the drawer by a simple operation.

2. Background of the Disclosure

In general, a refrigerator is a device for keeping stuff, such as foods, in a frozen or cool state for a long term of time.

The refrigerator may include a refrigerator main body having a cooling chamber, and a door to open and close the cooling chamber. The refrigerator main body is provided with a refrigerating cycle system for providing cold air into the cooling chamber.

FIG. 1 is a perspective view of an exemplary refrigerator according to the related art.

As shown in FIG. 1, the refrigerator according to the related art may include a refrigerator main body 10 having a cooling chamber 20, and a cooling chamber door 30 to open and close the cooling chamber 20.

The cooling chamber 20 may include a freezing chamber 21 and a refrigerating chamber 22.

The cooling chamber door 30 may include a freezing chamber door 31 and a refrigerating chamber door 32 to open and close the freezing chamber 21 and the refrigerating chamber 22, respectively.

A plurality of shelves which partition the refrigerating chamber 22 in a vertical direction may be provided in the refrigerating chamber 22.

A so-called vegetable storage chamber 50 to store vegetables and/or fruits may be provided in the refrigerating chamber 22.

The vegetable storage chamber 50 may be provided in plurality.

Each of the vegetable storage chambers 50 may be implemented as a drawer which can be drawn out and pushed in along back and forth directions of the vegetable storage chamber 50.

However, in the related art refrigerator, since internal air of the refrigerating chamber 22 is relatively low and dry, the vegetables and/or fruits stored in the vegetable storage chamber 50 may easily get dry. This may result in shortening storage duration.

Taking the problem into account, several types of refrigerators use a vegetable storage chamber (not shown) which has a sealing function of sealing the vegetable storage chamber and lower internal pressure of the vegetable storage chamber below atmospheric pressure.

The vegetable storage chamber having the sealing function may include a drawer sealing apparatus for maintaining a sealed state of the inside of the vegetable storage chamber when the drawer is pushed in.

However, the related art refrigerator having the drawer sealing apparatus is configured such that some components of the drawer sealing apparatus are operating (rotated) in an exposed state to the outside of the drawer. This may make it difficult to draw out and push in the drawer.

Also, foreign materials may be inserted into coupling areas of the components exposed to the outside the drawer, which may cause those components to be locked (blocked, stuck).

SUMMARY OF THE DISCLOSURE

Therefore, to overcome those drawbacks of the related art, an aspect of the detailed description is to provide a sealing apparatus for a drawer capable of drawing out and pushing in the drawer in a convenient manner.

Another aspect of the detailed description is to provide a refrigerator having a drawer sealing apparatus capable of preventing operable components from being locked during operation by way of internally receiving those operable components.

Another aspect of the detailed description is to provide a refrigerator having a drawer sealing apparatus capable of simultaneously closing (receiving) and sealing the drawer and simultaneously unsealing and drawing out the drawer.

To achieve these and other advantages and in accordance with the purpose of this specification, as embodied and broadly described herein, there is provided a refrigerator having a drawer sealing apparatus including a refrigerator main body having a cooling chamber, a case disposed in the cooling chamber and forming a storage space with a front surface open, a drawer received in the case to be drawn out, a sealing apparatus having hooks disposed on the drawer and rotatable between a sealing position of maintaining a sealed state with being engaged with the case and a release position of releasing the engaged state with the case, and hook springs applying an elastic force to the hooks to be rotated to the sealing position, a manipulation handle rotatably disposed on the drawer and rotating the hooks to the release position when being pulled, and an operation bar interposed between the manipulation handle and the hooks to transfer a driving force of the manipulation handle to the hooks.

Here, the hooks may be disposed on both sides of the drawer.

The drawer may include a manipulation handle receiving portion to rotatably receive the manipulation handle.

The drawer may include a guide to guide the operation bar to be slidable back and forth.

The refrigerator may further include at least one elastic member to apply an elastic force for rotating the manipulation handle to the release position.

The manipulation handle may include a pressing part contactable with the operation bar to press the operation bar.

The at least one elastic member may be disposed to press the operation bar toward the manipulation handle.

The manipulation handle may be rotatable downwardly when being pulled.

The manipulation handle may be rotatable upwardly when being pulled.

A flange may outwardly extend from a front surface of the case, and the flange may include stopping jaws engaged with the hooks.

A cut-off portion may be formed on a periphery of each stopping jaw, and the cut-off portion may be cut off for insertion of the hook therein.

The cut-off portion may have a width as wide as the outermost end of the hook being located within an outer line of the flange when the hook is rotated to the release position.

Each of the hooks may have a guide surface coming in contact with an edge of the stopping jaw to guide the hook to the release position.

The refrigerator may further include a sealing member disposed on a contact area between the case and the drawer. Here, the hooks and the stopping jaws may be engaged with each other in a state that the sealing member is pressed by a pressing force, which is applied by the drawer when the drawer is closed, so as to keep pressing the sealing member.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
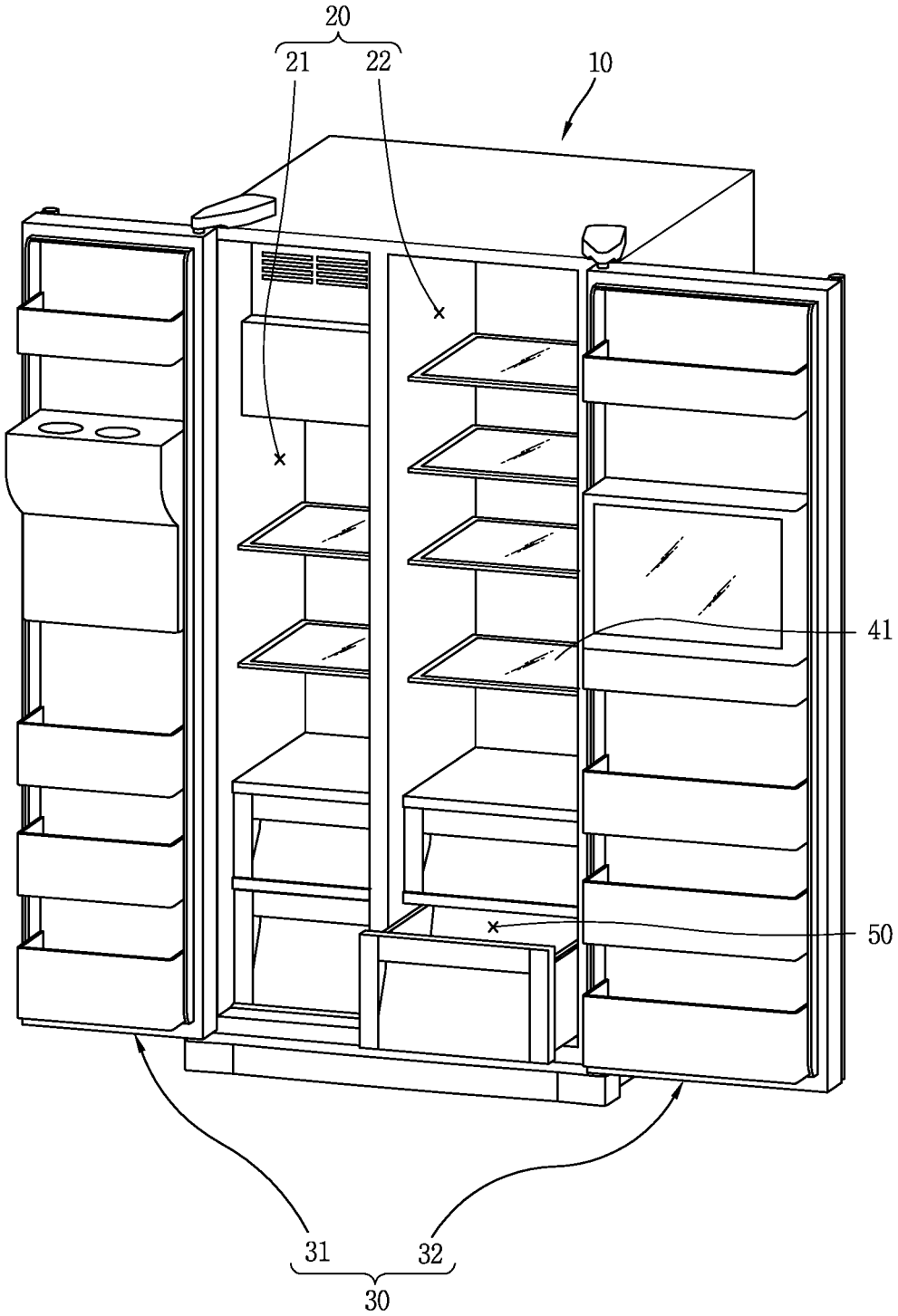
FIG. 1 RELATED ART
FIG. 1 is a perspective view of an exemplary refrigerator according to the related art.
Figure 2:
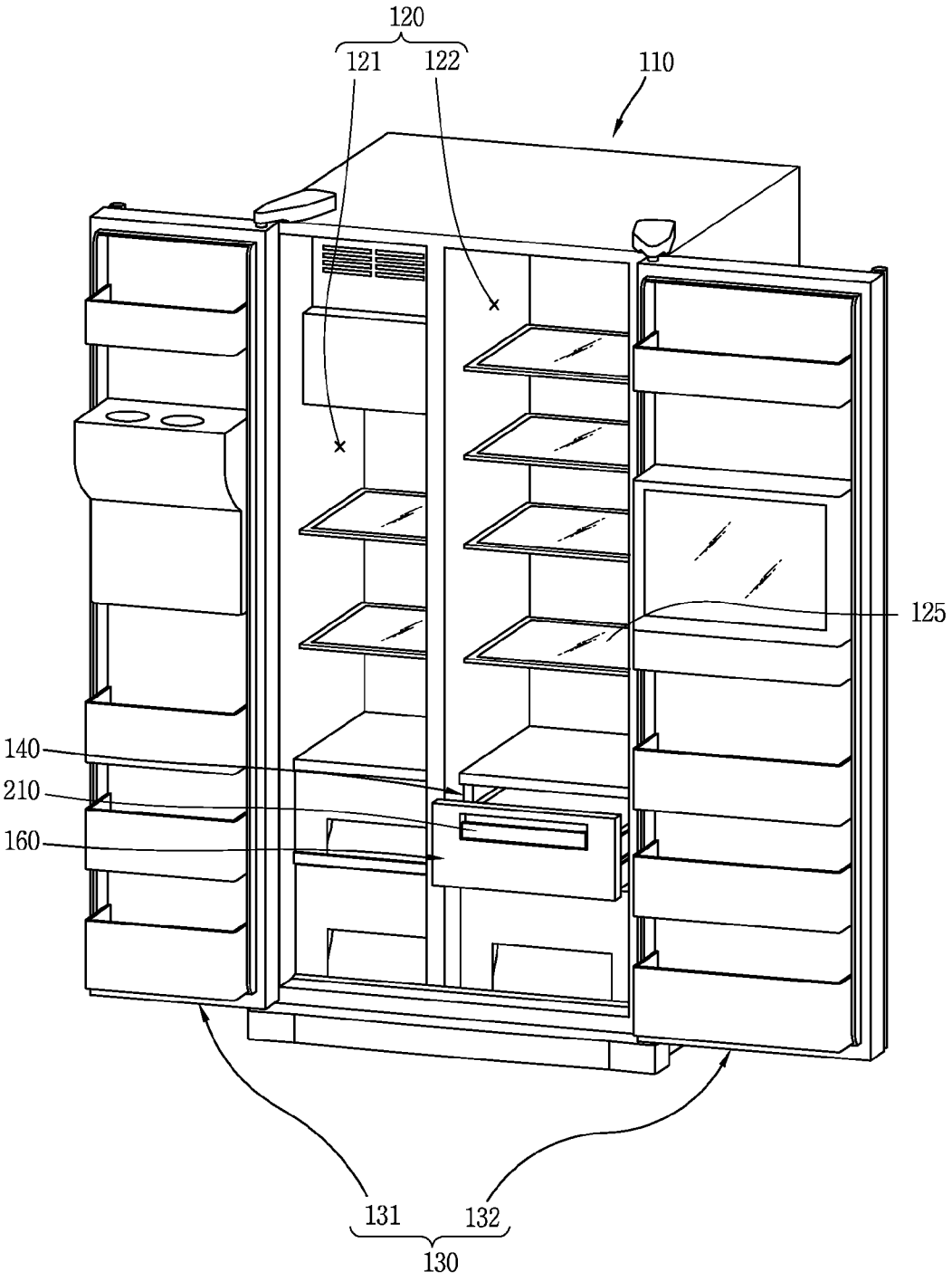
FIG. 2 is a perspective view of a refrigerator having a drawer sealing apparatus in accordance with one exemplary embodiment of the present disclosure.
Figure 3:
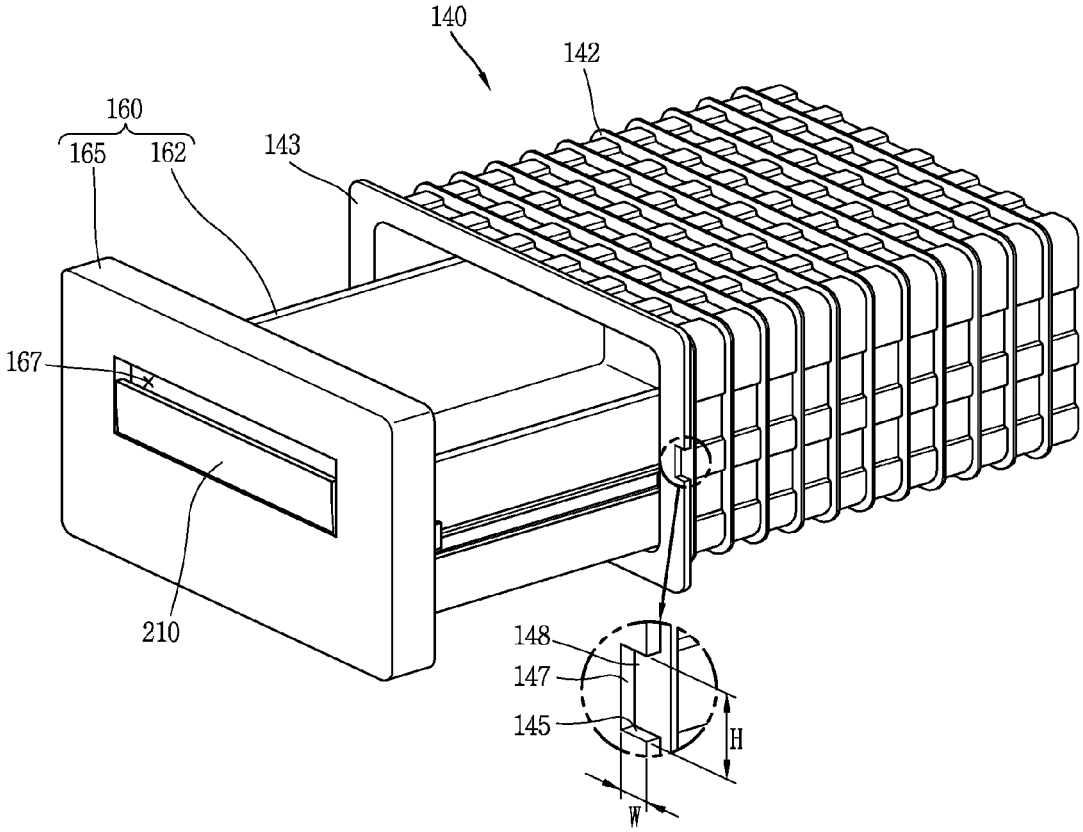
FIG. 3 is an enlarged perspective view of a drawer and a case region of FIG. 2.
Figure 4:
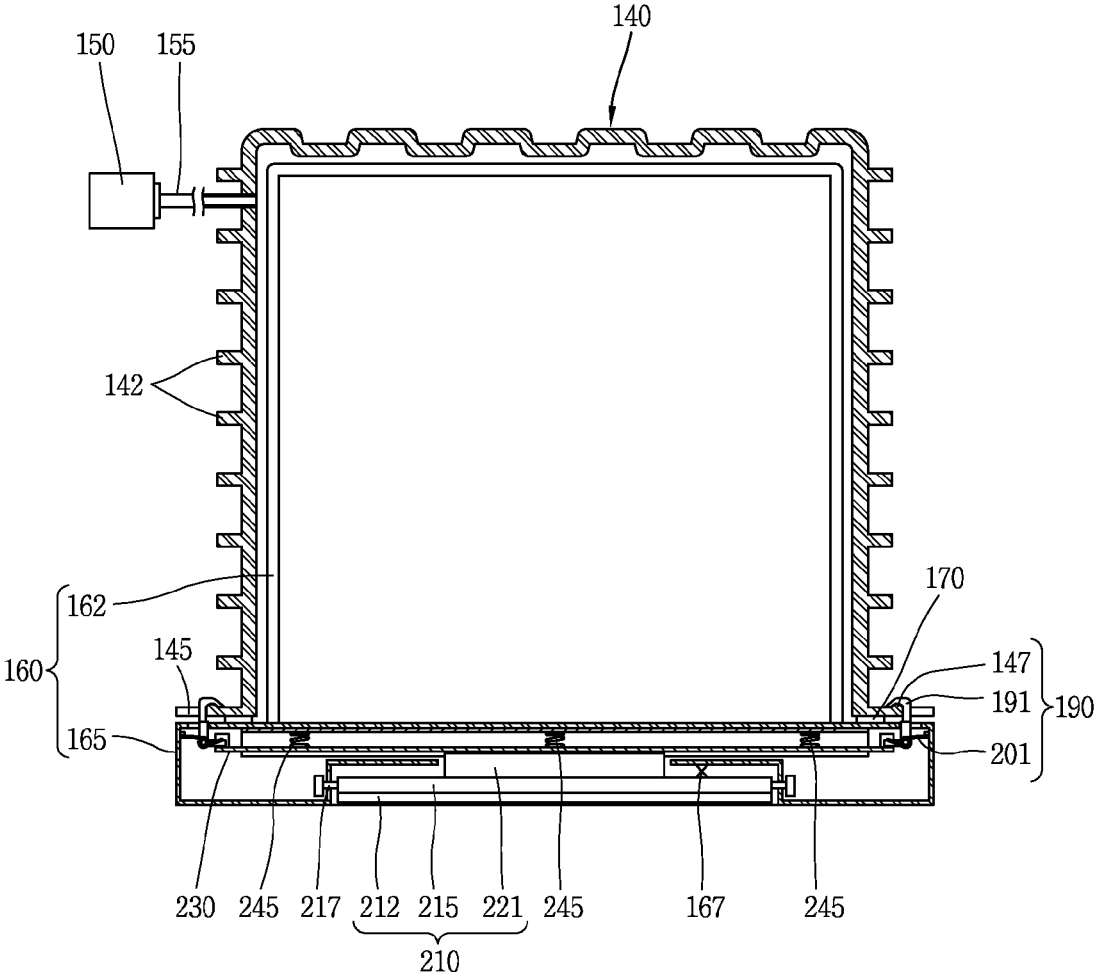
FIG. 4 is a planar sectional view when the drawer of FIG. 3 is received.

As shown in FIGS. 2 to 4, a refrigerator having a drawer sealing apparatus in accordance with one exemplary embodiment may include a refrigerator main body 110 having a cooling chamber 120, a case 140 disposed within the cooling chamber 120 and forming a storage space with a front surface open, a drawer 160 received within the case 140 to be drawn out, a sealing member 170 disposed on a contact area between the case 140 and the drawer 160, a sealing apparatus 190 having a hook 191 disposed on the drawer 160 and rotatable between a sealing position of maintaining a sealed state with being engaged with the case 140 and a release position where the engaged state with the case 140 is released, and a hook spring 201 to apply an elastic force for rotating the hook 191 to the sealing position, and a manipulation handle 210 rotatably installed on the drawer 160 to press the hook 191 to be rotated to the release position when being pulled out. Here, the cooling chamber 120 refers to a space for storing foods in a cooled state. The cooling chamber 120 may include a freezing chamber 121 and a refrigerating chamber 122. The refrigerator main body 110 may also be configured to have one of the freezing chamber 121 and the refrigerating chamber 122.

The refrigerator main body 110 may include the cooling chamber 120.

The refrigerator main body 110 may include a cooling chamber door 130 to open and close the cooling chamber 120.

The cooling chamber 120 may be provided in plurality.

For example, the cooling chamber 120 may include the freezing chamber 121 and the refrigerating chamber 122.

The cooling chamber door 130 may include a freezing chamber door 131 to open and close the freezing chamber 121, and a refrigerating chamber door 132 to open and close the refrigerating chamber 122.

A plurality of shelves 125 may be provided within the refrigerating chamber 122.

The drawer 160 may be disposed within the refrigerating chamber 122.

The drawer 160 may be provided in plurality.

The drawer 160, for example, may be received within the case 140, which forms a storage space with one surface open, to be drawn out.

The case 140 may be disposed such that its opening faces the front of the refrigerating chamber 122. This may allow the drawer 160 to be drawn out and received along back and forth directions of the refrigerating chamber 122.

The case 140, for example, may be formed in a shape of a rectangular parallelepiped whose front surface is open.

In more detail, the case 140 may have a front surface open and the other five surfaces closed.

A flange 143 may outwardly extend from the front surface of the case 140.

The case 140 may be formed of synthetic resin, for example.

A plurality of ribs 142 may be disposed on an outer surface of the case is 140, so as to prevent deformation of the case 140.

A decompressor or pump 150 (hereinafter, referred to as 'pump 150') may be disposed at one side of the case 140 to reduce internal pressure of the case 140.

A connection pipe 155 through which the pump 150 and the case 140 are communicated with each other may be disposed between the pump 150 and the case 140.

The drawer 160, for example, may include a storage part 162 for storing foods therein, and a front part 165 disposed on the front of the storage part 162.

The front part 165 may extend more than the storage part 162.

The front part 165 may be contactable with the flange 143 of the case 140.

The front part 165 may be formed in a shape of rectangular parallelepiped, for example.

A sealing member 170 may be interposed between the drawer 160 and the case 140.

The sealing member 170 may be disposed on the drawer 160.

The sealing member 170 may come in contact with the flange 143 to block a gap between the drawer 160 and the case 140, so as to seal the inner space.

The sealing member 170 may be made of rubber, for example.

The sealing member 170 may form a closed loop (a shape of a square ring).

Meanwhile, the sealing apparatus 190, by which inner spaces of the drawer 160 and the case 140 are maintained in a sealed state from the outside when the drawer 160 is received, may be installed on the drawer 160 and the case 140.

The sealing apparatus 190 may include a hook 191 disposed on the drawer 160 and rotatable between a sealing position of maintaining a sealed state with being engaged with the case 140 and a release position where the engaged state with the case 140 is released, and a hook spring 201 to apply an elastic force for rotating the hook 191 to the sealing position.

The hook 191, for example, may include a body 192 having a rotation shaft receiving portion 193 formed on one end thereof for insertion of a rotation shaft 194, and a curved end portion 195 curved from the other end of the body 192.

The hook 191 may be configured such that its rotation shaft is aligned along an up-and-down direction.

The hook 191 may be provided with a guide surface 196, which is contactable with the case 140 when the drawer 160 is received so as to guide the hook 191 to the release position.

In more detail, the guide surface 196 may be formed on an outer surface of the curved end portion 195.

The guide surface 196 may be configured such that its thickness gradually decreases along a protruding direction of the curved end portion 195.

The hook 191 may further include an arm 199 which extends from the rotation shaft receiving portion 193 in a different direction from the body 192. Accordingly, when the arm 199 is rotated, the hook 191 may be rotated centering around the rotation shaft 194.

The arm 199, for example, may be located approximately 90° from the body 192.

The hook 191 may be provided in plurality.

For example, the hook 191 may be provided by two in number on both sides of the drawer 160.

The hook spring 201 of the sealing apparatus 190 may apply an elastic force to the corresponding hook 191 such that the hook 191 can be rotated to the release position.

The hook spring 201 may be implemented as a torsion coil spring, for example.

The hook spring 201, for example, may be coupled to the rotation shaft 194 of the hook 191.

Meanwhile, the flange 143 of the case 140 may include stopping jaws 147 with which the hooks 191 are engaged.

The stopping jaws 147 may be formed on both sides of the flange 143 at positions corresponding to the hooks 191, respectively.

Each stopping jaw 147 may include a protrusion 148 which backwardly protrudes from its rear surface.

A cut-off portion 145 which is cut off to allow for the insertion of the hook 191 may be formed at a periphery of each stopping jaw 147.

The cut-off portion 145 may be cut off to have a height H which is higher than that of the hook 191.

Also, the cut-off portion 145 may be cut off with a width W such that the outermost end of the hook 191 is located within an outer line of the flange 143 at the release position of the hook 191. This may prevent an unnecessary interference upon the rotation of the hook 191 so as to allow for smooth rotation of the hook 191.

The hook 191 and the stopping jaw 147 may be engaged with each other in a state that the sealing member 170 is pressed by a pressing force, which is applied by the drawer 160 when the drawer 160 is closed (received), so as to keep pressing the sealing member 170.

The hook 191 may include a protrusion receiving portion 197 which is cut off (recessed) to receive the protrusion 148 of the stopping jaw 147. Accordingly, the engaged state between the hook 191 and the stopping jaw 147 can be stably maintained.

In the meantime, the drawer 160 may include a manipulation handle 210 for releasing the sealing apparatus 190.

The manipulation handle 210, for example, may be rotatably disposed on the drawer 160.

The manipulation handle 210 may be downwardly rotatable when being pulled.

In more detail, the manipulation handle 210 may be downwardly rotated when being pulled to draw out the drawer 160.

The manipulation handle 210, for example, may include a plate part 212 in a shape of a long plate, a rotation shaft receiving part 215 formed on one side (on a long side) of the plate part 212, and a pressing part 221 extending in an opposite direction to the plate part 212.

The plate part 212 may be formed in a shape of a long rectangular plate.

The rotation shaft receiving part 215 may be provided on a rear surface of the plate part 212.

The rotation shaft receiving part 215 may be spaced apart from the rear surface of the plate part 212 by a predetermined distance.

The plate part 212 may be located above the rotation shaft receiving part is 215. This may allow the plate part 212 to be downwardly rotated when the plate part 212 is pulled forwardly.

A rotation shaft 217 may be inserted into the rotation shaft receiving part 215. The rotation shaft 217 may be coupled to a rotation shaft supporting portion 218 disposed on the drawer 160.

An anti-sliding part 213 may be disposed on the other long side (an upper long side) of the plate part 212.

The anti-sliding part 213, for example, may be implemented as a protrusion, a rib or a concave-convex form, which backwardly protrudes from the rear surface of the plate part 212. This may prevent the manipulation handle 210 from being slid upon being pulled, thereby allowing the manipulation handle 210 to be smoothly pulled.

Figure 5:
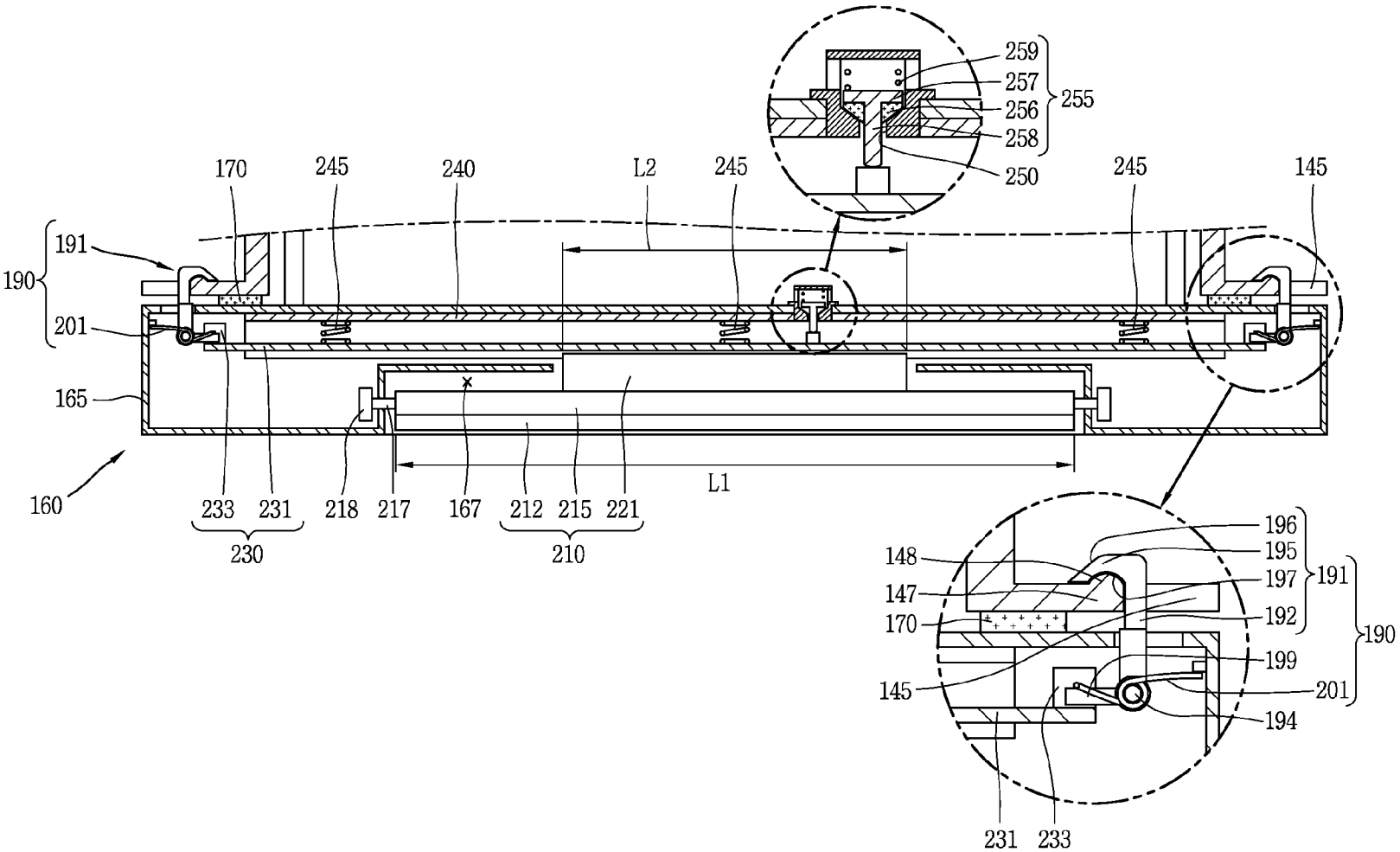
FIG. 5 is an enlarged view of main components of FIG. 4.

The pressing part 221, as shown in FIG. 5, may have a length L2 which is reduced rather than a length L1 of the plate part 212.

Figure 6:
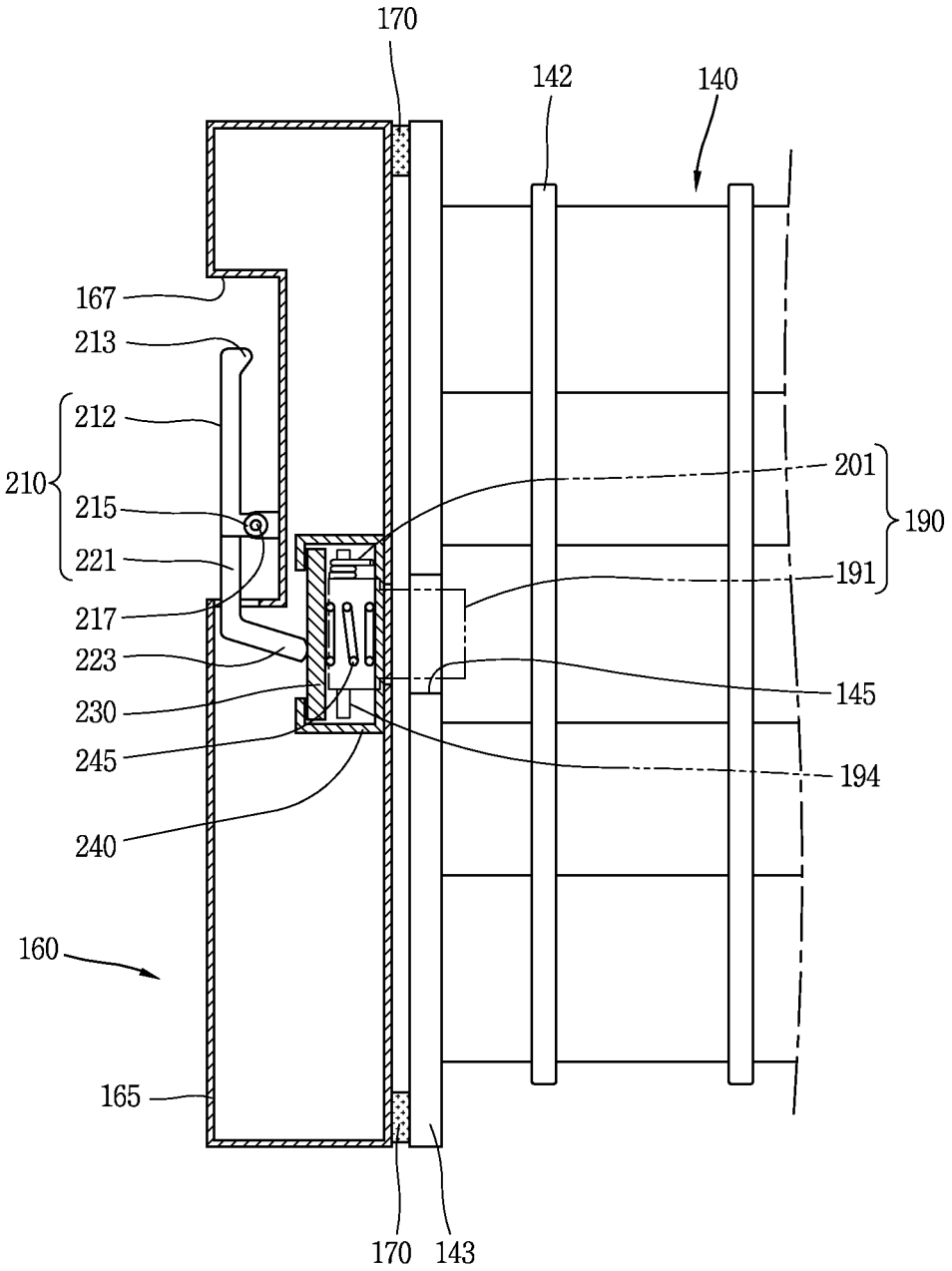
FIG. 6 is a lateral sectional view of FIG. 4.
Figure 7:
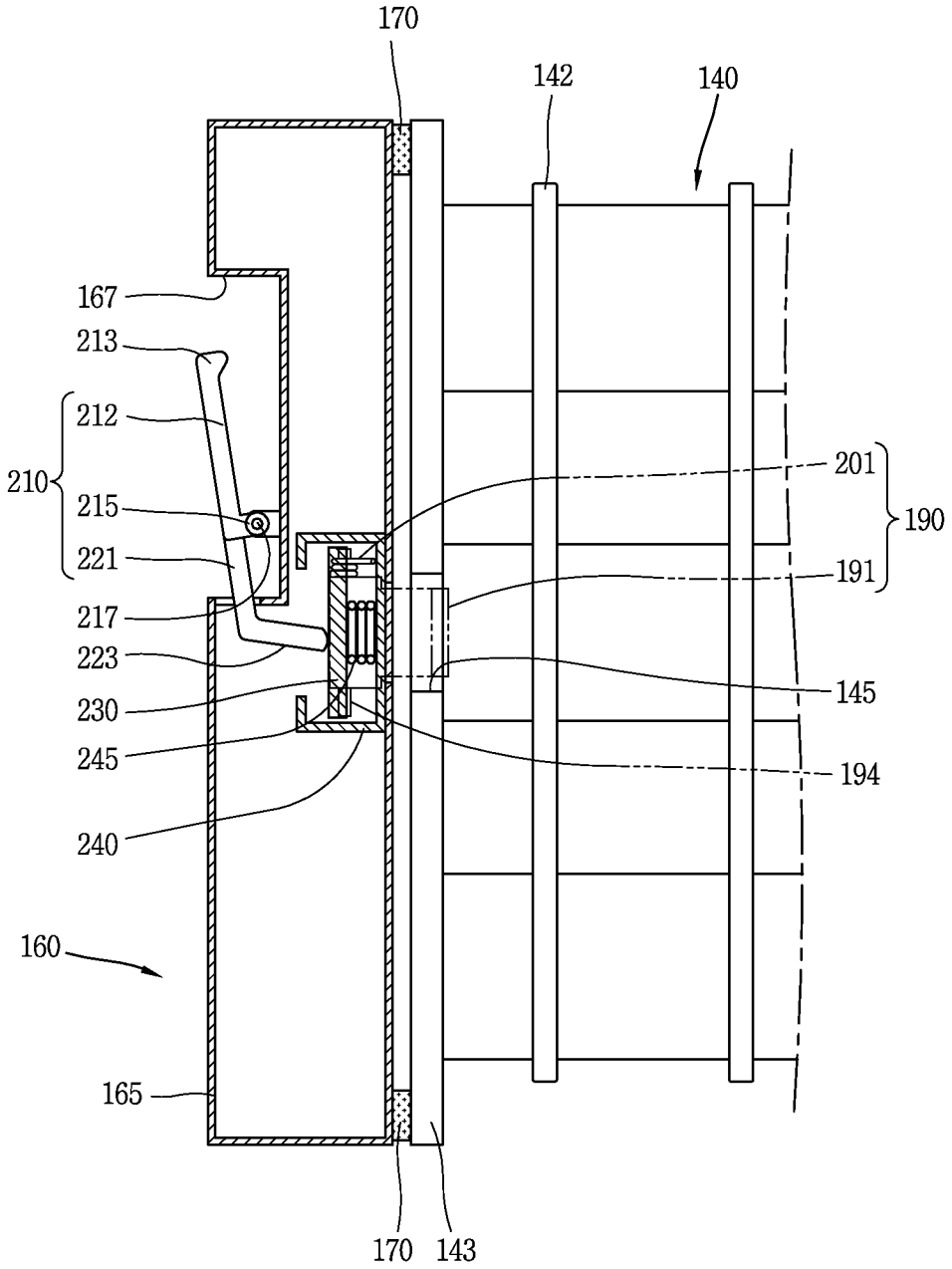
FIG. 7 is a view illustrating an operation of a manipulation handle of FIG. 6.
Figure 8:
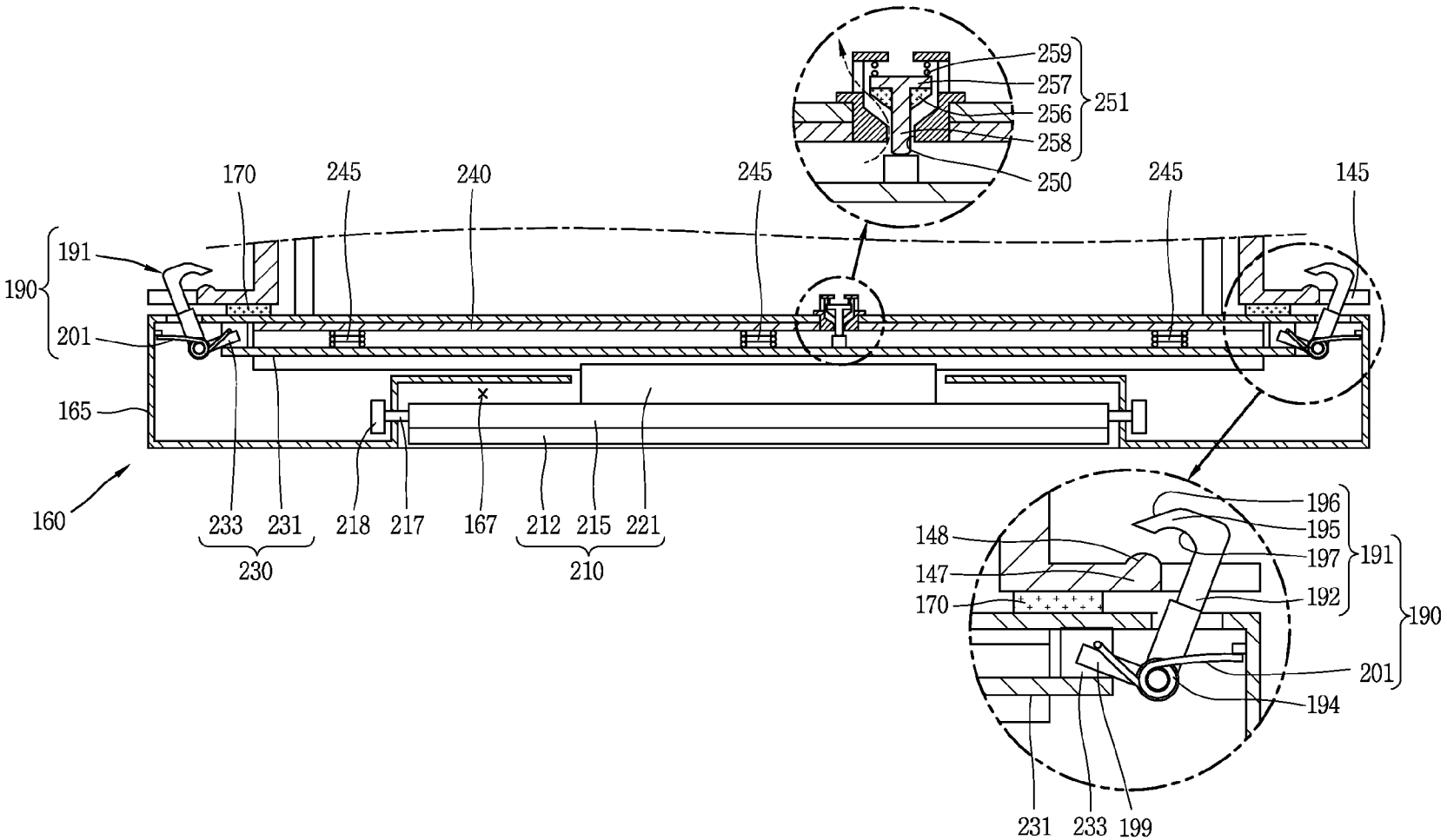
FIG. 8 is a view showing a release position of a hook of FIG. 4.

The pressing part 221, as shown in FIG. 6, may include a curved end portion 223 which is curved to the rear of the drawer 160. The curved end portion 223 may come in contact with a front surface of an operation bar 230 which will be explained later.

The drawer 160 may include a manipulation handle receiving portion 167 in which the manipulation handle 210 is rotatably received. This may prevent an unnecessary interference upon the rotation of the manipulation handle 210 so as to allow for smooth rotation of the manipulation handle 210.

An operation bar 230 for transferring a driving force of the manipulation handle 210 to the hook 191 may be located between the manipulation handle 210 and the hook 191.

The operation bar 230 may have a long length such that its both ends can simultaneously operate (or press) the respective hooks 191.

The operation bar 230 may be slidable along back and forth directions of the drawer 160.

In more detail, the operation bar 230 may be backwardly slid to a position where the operation bar 230 presses the hooks 191 to be rotated to the release position and forwardly slid to a position where it presses the hooks 191 to be rotated to the sealing position.

The operation bar 230, for example, may include an operation bar main body 231 in a shape of a bar, and pressing end portions 233 contactable with the arms 199 of the hooks 191 to press the arms 199.

The operation bar 230 may be made of a metal, for example.

The drawer 160 may include a guide 240 to guide the operation bar 230 to be slid along back and forth directions of the drawer 160.

The guide 240, for example, may come in contact with upper and lower surfaces of the operation bar 230 to guide the operation bar 230 to the front and rear sides.

The drawer 160 may include at least one elastic member 245 which applies an elastic force for the manipulation handle 210 to be rotated to the release position.

The elastic member 245, for example, may be disposed at the rear of the operation bar 230 to press the operation bar 230 toward the manipulation handle 210 (to the sealing position). With the configuration, when the operation bar 230 is slid to the release position by the elastic member 245, the pressing part 221 which has come in contact with the operation bar 230 may be pressed by the operation bar 230 and accordingly the manipulation handle 210 may be rotated to an initial position (the sealing position).

The elastic member 245 may be provided in plurality. This exemplary embodiment illustrates that the elastic member 245 is configured to press the operation bar 230 to the sealing position, but the elastic member 245 may alternatively be disposed to press the manipulation handle 210 to the sealing position.

Meanwhile, the drawer 160 may be provided with a communicating portion 250 for communicating inside and outside thereof with each other.

In more detail, the communicating portion 250 may be provided on the front part 165 of the drawer 160.

The communicating portion 250 may include an opening/closing member 255 to open and close the communicating portion 250.

The opening/closing member 255 may include an elastic portion 256 to open and close the communicating portion 250, a supporting portion 257 to support the elastic portion 256, a spring 259 to apply an elastic force to the supporting portion 257 to be moved to the communicating portion 250, and an operation rod 258 protruding from the supporting portion 257.

The operation rod 258 may protrude to come in contact with the operation bar 230 through the communicating portion 250. With this configuration, when the operation bar 230 is slid to the release position, the operation rod 258 may be pressed by the operation bar 230. Accordingly, the elastic member 256 may be separated from the communicating portion 250 and the communication portion 250 may be open.

Consequently, when desiring to receive the drawer 160 into the case 140, is the front part 165 of the drawer 160 may be pressed toward the case 140.

When the drawer 160 is received in the case 140, the sealing member 170 may come in contact with the flange 143 of the case 140.

When the front part 165 of the drawer 160 approaches the flange 143 of the case 140, the hooks 191 protruding from the front part 165 may be rotated to the release position based on the rotation shaft 194 as the guide surfaces 196 come in contact with the stopping jaws 147.

When the drawer 160 is continuously moved, the sealing member 170 may be pressed and the hooks 191 may be rotated to the sealing position by the elastic force of the hook springs 201.

When the hooks 191 are rotated to the sealing position, the movement of the drawer 160 in the draw-out direction may be prevented. This may allow the sealing member 170 to be kept pressed. Here, since the protrusions 148 are received in the protrusion receiving portions 197 of the hooks 191, the hooks 191 may be prevented from being unexpectedly rotated to the release position and be stably maintained.

When the drawer 160 is received and sealed, internal pressure of the case 140 may be lowered to a preset pressure, which is lower than atmospheric pressure, by the pump 150.

Meanwhile, when desiring to draw out the drawer 160, the manipulation handle 210 may be grabbed and pulled forwardly.

In more detail, when the manipulation handle 210 is grabbed and pulled, the manipulation handle 210 may be rotated based on the rotation shaft 217.

When the manipulation handle 210 is rotated downwardly, the pressing part 221 may press the operation bar 230 to the rear side.

Accordingly, the operation bar 230 may be slid to the rear side, namely, the release position. Here, the operation rod 258 may also be pressed to open the communicating portion 250. This may allow external air to be introduced into the case 140, thereby releasing a vacuum state of the case 140.

When the operation bar 230 is slid backwardly, each hook 191 may be separated from the stopping jaw 147 and rotated to the release position.

When the hooks 191 are released, the drawer 160 may be drawn forwardly.

As described above, in the refrigerator having the drawer sealing apparatus, when the drawer 160 is received, the reception may be carried out by a simple operation of pushing the drawer 160 toward the case 140 and also the sealing apparatus 190 may be continuously operating to stably maintain the sealed state without an additional operation. This may result in enhancement of user convenience.

Also, upon drawing the drawer 160 out, a vacuum state of the drawer 160 may be release by a simple operation of pulling out the manipulation handle 210, and the sealing apparatus 190 of the drawer 160 may also be released and the drawer may be drawn out without an additional operation. This may result in enhancement of user convenience.

Hereinafter, description will be given of a refrigerator having a drawer sealing apparatus in accordance with another exemplary embodiment, with reference to FIG. 9.

For the sake of brief description with reference to the drawings, the same or equivalent components will be provided with the same reference numbers, and description thereof will not be repeated.

Figure 9:
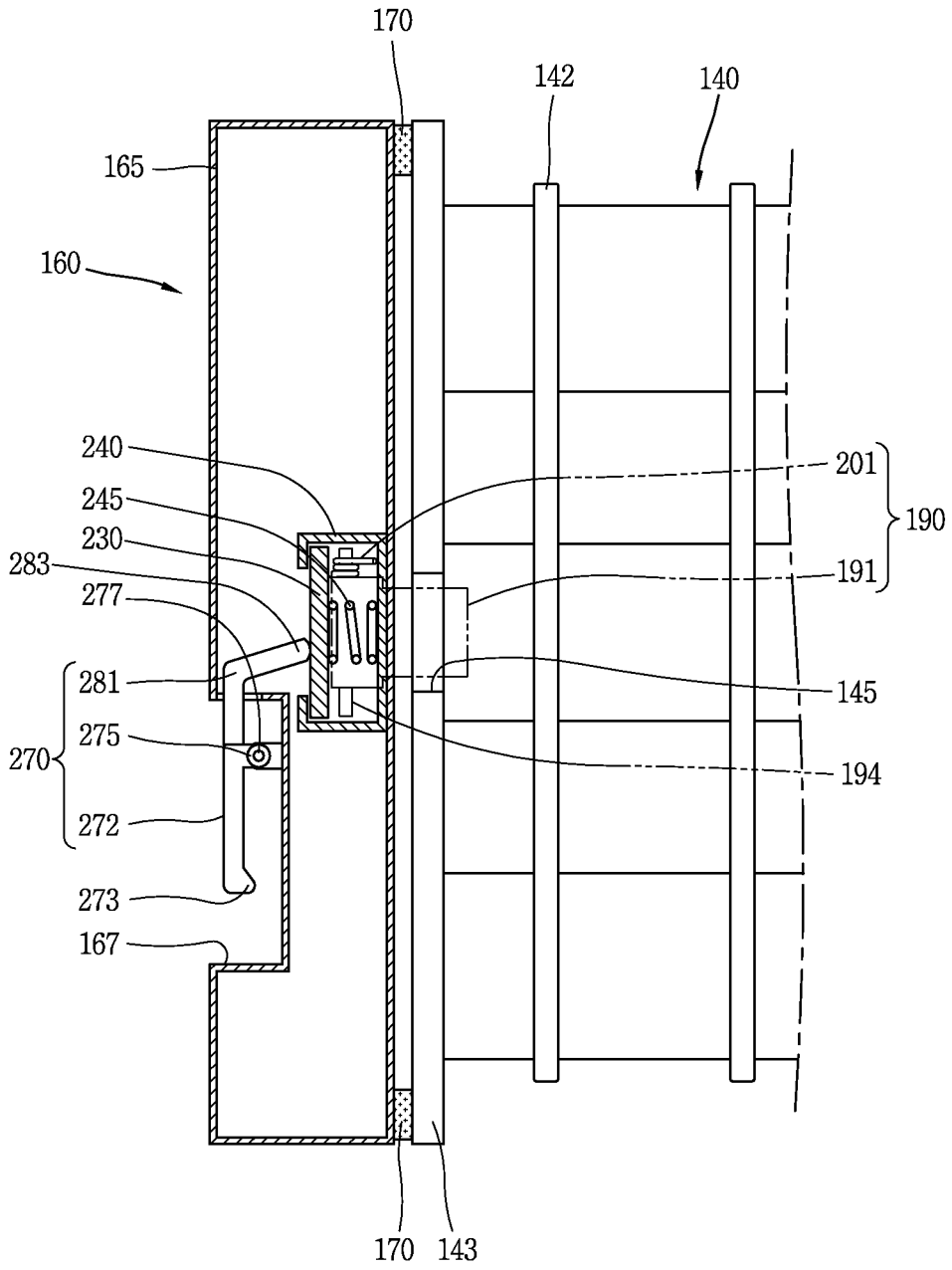
FIG. 9 is a lateral sectional view showing a received state of a drawer of a refrigerator having a drawer sealing apparatus in accordance with another exemplary embodiment of the present disclosure.

A refrigerator having a drawer sealing apparatus in accordance with another exemplary embodiment, as shown in FIG. 9, may include a case 140 disposed in a cooling chamber 120 and having a storage space with a front surface open, a drawer 160 received in the case 140 to be drawn out, a sealing apparatus 190 having a hook 191 disposed on the drawer 160 and rotatable between a sealing position where the hook 191 is engaged with the case 140 to maintain a sealed state and a release position where the engaged state between the hook 191 and the case 140 is released, and a hook spring 201 to apply an elastic force to the hook 191 to be rotated to the sealing position, and a manipulation handle 270 rotatably disposed on the drawer 160 and pressing the hook 191 to be rotated to the release position.

The manipulation handle 270, for example, may be upwardly rotatable when being pulled. In more detail, the manipulation handle 270 may be rotated up when being pulled for drawing the drawer 160 out.

More concretely, the manipulation handle 270 may include a plate part 272 in a shape of a plate, a rotation shaft receiving part 275 formed on one side (on a long side) of the plate part 272, and a pressing part 281 extending in an opposite direction to the plate part 272.

The plate part 272 may be disposed below the rotation shaft receiving part 275. This may allow the plate part 272 to be rotated up based on a rotation shaft 277 when the plate part 272 is pulled.

The rotation shaft 277 may be inserted into the rotation shaft receiving part 275. The rotation shaft 277 may be rotatably supported by being coupled to a rotation shaft supporting portion 218 of the drawer 160.

An anti-sliding part 273 may be disposed on the other long side (an upper is long side) of the plate part 272.

Here, the plate part 272, unlike the previous embodiment, may be reduced into the same length as the pressing part 281.

The pressing part 281 may include a curved end portion 283 curved to come in contact with the operation bar 230 so as to press the operation bar 230.

With the configuration, when desiring to draw the drawer 160 out, the manipulation handle 270 may be pulled forwardly.

When the manipulation handle 270 is pulled forwardly, the manipulation handle 270 may be rotated up based on the rotation shaft 277. When the manipulation handle 270 is rotated up, the pressing part 281 may press the operation bar 230 to the rear side.

When the operation bar 230 is slid to the rear side, the communicating portion 250 may be open so as to release a vacuum state of the case 140. The operation bar 230 may press the arm 199 of each hook 191 while being slid to the release position. Accordingly, each hook 191 may be separated from the stopping jaw 147 and rotated to the release position. Consequently, the drawer 160 may be drawn forwardly.

As described above, according to one exemplary embodiment, with employing the hook rotatable between the sealing position and the release position and the hook spring to rotate the hook to the sealing position, the drawer can be received and sealed in the case by a simple operation of pressing the drawer into the case and the sealed state can be continuously maintained.

With employing the manipulation handle rotatably disposed on the drawer for pressing the hook to be rotated to the release position upon being pulled, the sealing apparatus may be released and the drawer can be drawn out by a simple is operation of puling the manipulation handle in the drawing-out direction.

With the simple operation of pulling the manipulation handle, the release of the vacuum state of the case, the release of the sealing apparatus and the drawing-out of the drawer may be carried out in a sequential manner, enhancing user convenience.

Since operable components are received in the drawer, unnecessary sticking (locking, blocking) of such components, which has been caused when the components are externally exposed, may be prevented.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A refrigerator comprising:

a refrigerator body having a cooling chamber;

a case disposed in the cooling chamber and forming a storage space with a front surface open;

a drawer withdrawably received in the case;

a sealing apparatus having hooks disposed on the drawer and rotatable between a sealing position in which the hooks engage with the case to provide a sealed state where the storage space of the case and the drawer received in the storage space are sealed from an outside and a release position in which the hooks disengage with the case to release the sealed state of the storage space of the case, and hook springs to apply an elastic force to the hooks to rotate to the sealing position;

a manipulation handle rotatably disposed on the drawer to rotate the hooks to the release position when the manipulation handle is pulled;

an operation bar interposed between the manipulation handle and the hooks to transfer a driving force of the manipulation handle to the hooks; and a communicating portion disposed at the drawer, the communicating portion having an opening and closing member, wherein the opening and closing member opens when the hooks are rotated to the release position, thereby the storage space of the case communicates with the outside.

2. The refrigerator of claim 1, wherein the hooks are disposed on two opposing sides of the drawer.

3. The refrigerator of claim 1, wherein the manipulation handle comprises an anti-sliding part on a surface facing the drawer.

4. The refrigerator of claim 1, wherein the drawer comprises a manipulation handle receiving portion to rotatably receive the manipulation handle.

5. The refrigerator of claim 1, wherein the drawer comprises a guide in which at least a portion of the operation bar is disposed, to guide the operation bar to slide backward and forward within the guide.

6. The refrigerator of claim 5, further comprising at least one elastic member to apply an elastic force to rotate the manipulation handle back to an original position after the manipulation handle is pulled.

7. The refrigerator of claim 6, wherein the manipulation handle comprises a pressing part contactable with the operation bar to press the operation bar.

8. The refrigerator of claim 7, wherein the at least one elastic member is disposed to press the operation bar toward the manipulation handle.

9. The refrigerator of claim 4, wherein the manipulation handle is disposed in the manipulation handle receiving portion to rotate in one of upward or downward direction when the manipulation handle is pulled.

10. The refrigerator of claim 1, wherein the case comprises a flange extending outwardly from the open front surface of the case, and the flange comprises stopping jaws to engage with corresponding hooks.

11. The refrigerator of claim 10, wherein the flange comprises a cut-off portion formed on a periphery of the stopping jaws, the cut-off portion being cut off for insertion of a corresponding hook therein.

12. The refrigerator of claim 11, wherein the cut-off portion of the flange has a width corresponding to an outermost end of the hook being located within an outer line of the flange when the hook is rotated to the release position.

13. The refrigerator of claim 10, wherein the stopping jaws comprise a protrusion protruding from a surface of the stopping jaws that engage with the corresponding hooks; and the corresponding hooks comprise a protrusion receiving portion having a contour corresponding to the protrusion of the stopping jaws.

14. The refrigerator of claim 10, wherein the hooks comprise a guide surface which when the guide surface comes in contact with the case, the guide surface guides the hooks to the release position.

15. The refrigerator of claim 14, wherein the guide surface is on an outer surface of a protruding end of the hooks, and the thickness of the protruding end gradually decreases along a protruding direction of the protruding end of the hooks corresponding to the guide surface.

16. The refrigerator of claim 10, further comprising a sealing member disposed on a contact area between the case and the drawer, wherein the hooks and the stopping jaws are engaged with each other in a state that the sealing member is pressed by a pressing force, which is applied by the drawer when the drawer is closed, so as to keep pressing the sealing member.

17. The refrigerator of claim 1, wherein the hooks comprise an arm and when the arm is rotated, the hooks rotate centered around a rotation shaft of the hooks, wherein the operating bar is contactable with the arm of the hooks, and rotates the arm of the hooks to rotate the hooks.

18. The refrigerator of claim 1, wherein the opening and closing member comprises an elastic portion to open and close the communicating portion; a supporting portion to support the elastic portion; a spring to apply an elastic force to the supporting portion; and an operation rod protruding from the supporting portion, which when engaged causes the elastic portion to open the communicating portion.

19. The refrigerator of claim 18, when the operating rod of the communicating portion abuts the operating bar and when the operating bar is engaged to rotate the hooks to the release position, the operating bar engages the operating rod of the communicating portion.

* * * * *